US006474508B1

(12) United States Patent
Marsh

(10) Patent No.: US 6,474,508 B1
(45) Date of Patent: Nov. 5, 2002

(54) UNIT DOSE TUBE AND CAP ASSEMBLY

(75) Inventor: Timothy R. Marsh, Bethlehem, PA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/053,738

(22) Filed: Jan. 24, 2002

(51) Int. Cl.[7] ..... B67D 5/00
(52) U.S. Cl. ..... 222/83; 222/538; 222/570
(58) Field of Search ..... 222/83, 538, 570, 222/207; 401/134

(56) References Cited

U.S. PATENT DOCUMENTS 3,406,872 A * 10/1968 Fiquet et al. ..... 222/83
5,042,690 A 8/1991 O'Meara
5,419,459 A 5/1995 O'Meara
5,469,980 A * 11/1995 O'Meara et al. ..... 222/83
5,590,780 A 1/1997 O'Meara
5,609,581 A 3/1997 Fletcher et al.
5,769,552 A 6/1998 Kelley et al.

* cited by examiner

*Primary Examiner*—Philippe Derakshani
(74) *Attorney, Agent, or Firm*—Dykema Gossett PLLC

(57) ABSTRACT

The cap of a unit dose tube and cap assembly has a dished shape outer wall defining a receptacle for liquid to be topically applied to the body. A groove is formed in the outer wall for snap-fitting engagement with a retention bead on the neck portion of the flexible walled tube for mounted the cap over a rupturable membrane which seals the discharge passage formed by the neck portion. The cap has a coaxial hollow spike and an annular groove in its outer wall likewise for snap-fitting engagement with the retention bead of the container neck portion in a position of use of the assembly. In such position the hollow spike ruptures the thin membrane wall and its passageway establishes communication between to the interior of the tube and the receptacle formed in the cap. An annular bead on the outer periphery of the receptacle aids in spreading the topical application.

6 Claims, 2 Drawing Sheets

25
24
24
10
14
11

14
10
24
24
25
13
12
18
11

17
16
15
26
10
20
14
21
24
24
25
13
18
12
18
19
11

UNIT DOSE TUBE AND CAP ASSEMBLY

BACKGROUND OF THE INVENTION

This invention relates generally to a unit dose squeeze tube and cap assembly and more particularly to a cap for use with a sealed squeeze tube for both opening the seal and effecting the unit dose in the application of the liquid product from the tube. The tube may contain a single dose of topical ointment, medicine, eyewash, scalp application, etc., or may contain a small supply thereof which is measured with the use of the cap.

Squeeze tubes are oftentimes sealed during periods of non-use such as during shipping and storage, by the provision of a thin membrane which seals the outer edge of the tube neck. The membrane must thereafter be punctured or removed using some type of separate tool to gain access to the tube contents. Otherwise the membrane is punctured using a tube cap having a hollow spike for this purpose. U.S. Pat. No. 5,042,690 discloses a cap for the squeeze tube having such a hollow spike for puncturing a thin membrane sealing the tube, the cap likewise including a spongy applicator for containing the contents squeezed from the tube.

In a non-use position, the cap is mounted to the tube neck such that the end of the spike is spaced away from the membrane, and in a use position the cap is moved inwardly along the tube neck such that the 'hollow spike punctures the membrane and extends into the tube neck. This prior art arrangement of the cap is undesirable since during shipping and storage during the non-use condition, the membrane can be inadvertently punctured by accidentally shifting the cap inwardly of the container neck. Also, the spongy applicator limits the application use of the liquid product contained in the tube.

SUMMARY OF THE INVENTION

It is therefore an object of the present invention to provide a unit dose squeeze tube and cap assembly in which the cap normally safely protects the seal on the tube.during shipping and storage, but provides a means to break the seal, and further serves as an aid in the spreading of the squeezed liquid on the target without the need for any spongy or other type of special material.

In keeping with this objective the tube neck portion has an external cap retention bead, and the cap has grooves in its inner and outer walls for snap fitting engagement with the bead respectively in non-use and use positions. The cap is dish shape at its inner wall for retaining a metered amount of squeezed fluid, and the outer perimeter of the dish has a bead serving as an aid in applying the fluid product topically on the body of the user. The cap likewise has a coaxial hollow spike establishing communication with the receptacle and the contents of the tube in a position of use as the cap is snap fitted to the tube neck port. In the non-use position before the membrane is punctured, the tube is flipped over such that its groove at the receptacle side snap fits with the bead on the tube neck portion for protecting the seal during conditions of non-use.

Other objects, advantages, and novel features of the invention will become more apparent from the following detailed description of the invention when taken in conjunction with the accompanying drawings.

DETAILED DESCRIPTION OF THE INVENTION

Figures 1, 2, 3:
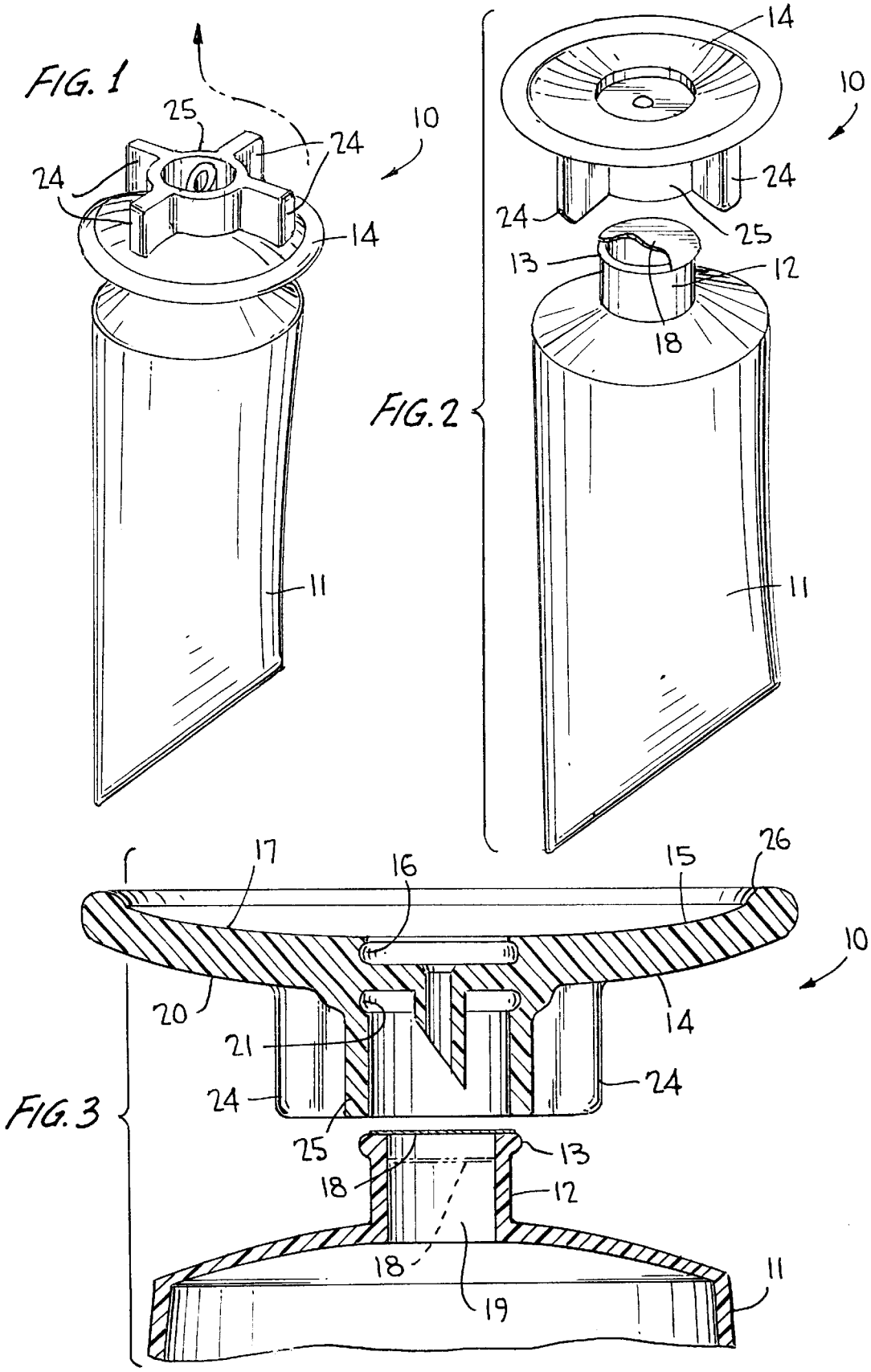
FIG. 1 is a perspective view of the tube and cap shown in the non-use position of shipping and storage.
FIG. 2 is a view similar to FIG. 1 showing the cap as inverted in readiness to be snap fitted with the tube neck portion in a use position.
FIG. 3 is vertical sectional view of a portion of the tube and the cap shown expanded and prior to rupture of the membrane by the spike on the cap in its inverted position.

Turning now to the drawings wherein like reference characters refer to like and corresponding parts throughout the several views, the unit dose tube and cap assembly according to the invention is generally designated 10 in the drawings, and includes a tube 11 having at least one flexible wall portion of flexible material to facilitate the dispensing of product from the tube by squeezing. The tube has a neck portion 12 with an external annular retention bead 13. The tube may contain a quantity of fluid for topical application to the human body, such as hair and scalp preparation, other body part applications, eyewash, disinfected, etc. The tube may contain a single dose of such product or may contain a number of doses.

Cap 14 according to the invention has a concavo-convex wall 17 defining a liquid product receptacle 15 having an annular groove 16. The cap may be thus snap-fitted to neck portion 12 of the tube as groove 16 is snap-fitted to bead 13. A rupturable seal which may comprise a thin wall membrane 18 is adhered to otherwise applied over discharge opening 19 of neck portion 12 for sealing the contents of the tube against product leakage and against air entry. In the FIG. 4 position of non-use, such during shipping and storage, rupturable seal 18 is protected by cap 14 without the likelihood of seal puncture from foreign objects. Cap 14 has another annular groove 21 formed in the opposing wall of the receptacle for snap-fitting with retention bead 13 in a position of use as shown in FIG. 5. The cap further has a coaxial hollow spike 22 defining a passageway 23. In the use condition of FIG. 5, the hollow spike with its sharp pointed end ruptures seal 18 as the cap is shifted downwardly from its FIG. 3 to its FIG. 5 position. The cap is securely retained in place upon the snap-fit engagement between groove 21 and bead 13, and passageway 23 establishes communication between the interior of the tube and receptacle 17.

The cap further has gripping means of some type on its outer wall such as a plurality of radially extending fins 24 which may radiate from a central sleeve 25.

Finally the receptacle may be provided with an annular bead 26 which serves as an aid in applying the topical product to the body, and also serves as a lip to prevent spillage when used, for example, as an eyewash.

Figure 4:
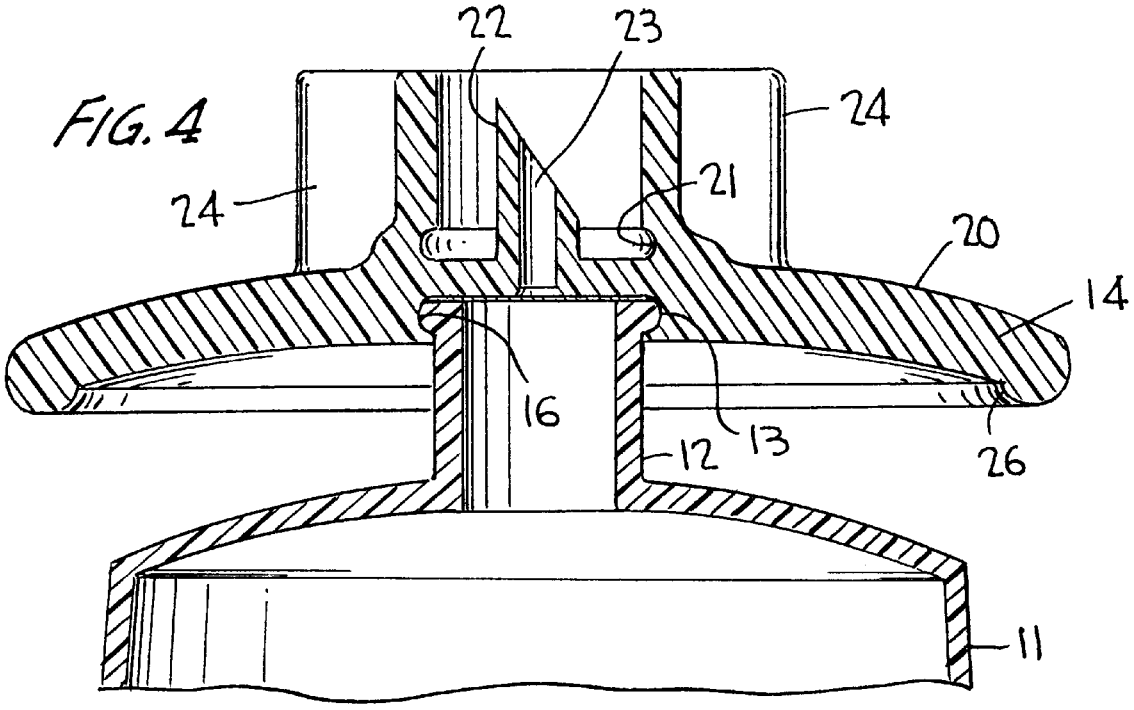
FIG. 4 is a view similar to FIG. 3 showing the cap snap fitted to the tube neck portion in its position of non-use.
Figure 5:
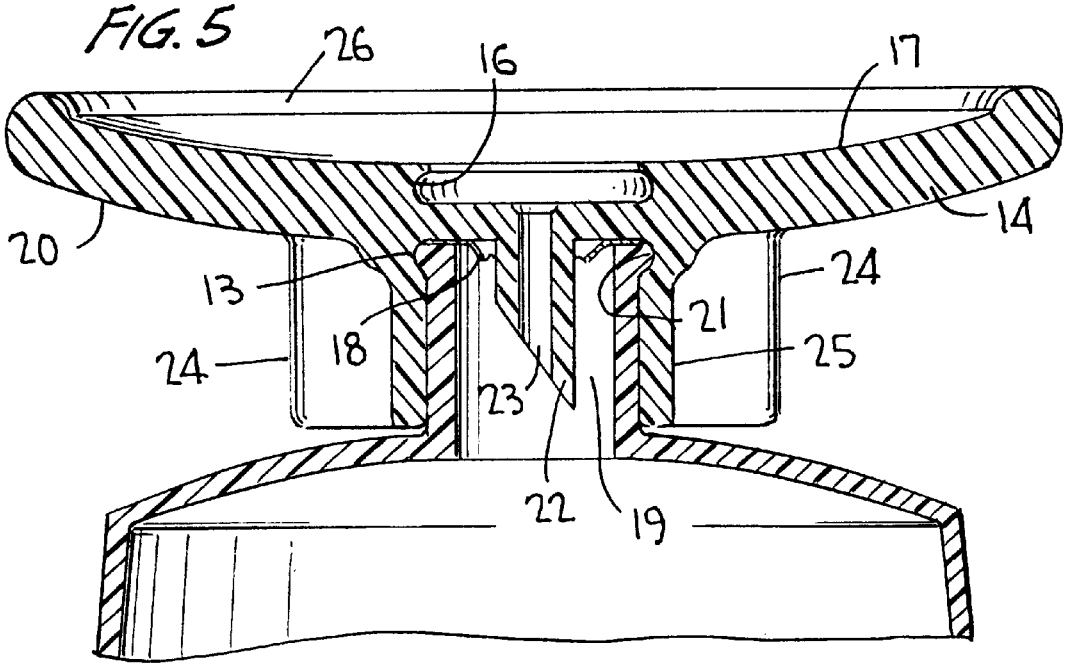
FIG. 5 is a view similar to FIG. 4 showing the cap inverted with the spike puncturing the seal in the use position.

The assembly according to the invention is shipped and stored in the position of FIGS. 1 and 4 of the cap, i.e., with its groove 16 snap-fitted to bead 13 protecting the rupturable seal against inadvertent puncture. In use, cap 14 is removed by applying a slight twist and upward lift thereto as in the direction of the curved arrows of FIG. 1 and is simply inverted as in FIGS. 2 and 3. Its spike 22 is aligned with the container neck and the cap is pressed down over the neck until its groove 21 snap-fits with retention bead 13 which thereby retains the cap in its position of use FIG. 5. In the process of snap-fitting the cap in place, the sharp spike punctures membrane 18 and establishes communication between the interior of the tube and receptacle 17. Thus, upon squeezing the tube wall or walls, product is forced through discharge opening 19 and passageway 23 and fills receptacle 15. Fins 24 enable the user to easily manipulate the cap when inverting it from its FIG. 1 to its FIG. 2 positions. And, bead 26 serves to smooth or spread the topical product against the body.

From the foregoing it can be seen that a simple and efficient yet highly effective unit dose squeeze tube and cap assembly has been devised which is of a simple construction, and is rendered essentially tamper proof and child proof and is easy to use without the likelihood of puncturing the thin walled membrane inadvertently during shipping and storage. The cap seals the membrane during periods of non-use, serves to puncture the membrane in use, and its disc shaped pad area serves as an aid in spreading the liquid against the body.

Obviously, many modifications and variations of the present invention are made possible within the light of the above teachings. For example, thin membrane 18 may be provided at the distal end of neck portion 12 as shown or may be provided at a spaced distance from that end as shown in phantom outline in FIG. 3. Groove 21 may be provided along the length of sleeve 25, and groove 16 may be provided along a sleeve (not shown) rather than as a depression within the receptacle as shown, without departing from the invention. It is therefore to be understood that within the scope of the appended claims the invention may be practiced otherwise than as specifically described.

What is claimed is:

1. A tube and cap assembly, comprising: a squeeze tube containing a fluid product to be dispensed and having at least one flexible wall portion permitting the tube to be manually squeezed for dispensing the product, the tube having a neck portion defining a discharge passage, an external cap retention bead on said neck portion;

a cap having a wall defining a receptacle for the fluid product, a groove in an inner wall of the receptacle and a groove in an outer wall of the receptacle each for engagement with said bead respectively in non-use and use positions;

a rupturable seal closing the discharge passage in the non-use position; and the cap having a hollow seal puncturing spike coaxial with the tube neck portion, said spike extending outwardly of said outside wall and extending outwardly of said neck portion in said non-use position, and said spike extending through the seal and into the neck portion in the use position for establishing communication between the interior of the tube and the inner wall of the receptacle.

2. The assembly according to claim 1, wherein the receptacle wall has an annular ridge to aid in spreading the fluid product when the receptacle is filled with the product used as a topical application upon a squeezing of the tube.

3. The assembly according to claim 1, wherein means on the outer wall of the receptacle are provided for manually gripping the cap in the non-use position.

4. The assembly according to claim 3, wherein the gripping means comprise a plurality of radial fins.

5. The assembly according to claim 1, wherein the rupturable seal comprises a thin membrane at the distal end of the neck portion.

6. The assembly according to claim 1, wherein the rupturable seal comprises a thin membrane spaced inwardly of the distal end of the neck portion.

* * * * *